United States Patent [19]

Matsumura et al.

[11] 4,391,534

[45] Jul. 5, 1983

[54] GLASS MOUNTING STRUCTURE FOR WATCHES

[75] Inventors: Osamu Matsumura; Masataka Matsumoto, both of Tanashi, Japan

[73] Assignee: Citizen Watch Co., Ltd., Tokyo, Japan

[21] Appl. No.: 289,840

[22] Filed: Aug. 4, 1981

Related U.S. Application Data

[63] Continuation of Ser. No. 114,743, Jan. 24, 1980.

[30] Foreign Application Priority Data

Jan. 27, 1979 [JP] Japan ..... 54-9027[U]

[51] Int. Cl.[3] ..... G04B 39/02

[52] U.S. Cl. ..... 368/294; 368/287; 368/289; 368/291

[58] Field of Search ..... 368/276, 286, 287, 289, 368/291, 294

[56] References Cited

U.S. PATENT DOCUMENTS

| | | | |
|---|---|---|---|
| 2,327,112 | 8/1943 | Kramer et al. | 368/291 |
| 3,858,388 | 1/1975 | Fujimori et al. | 368/294 |
| 3,934,402 | 1/1976 | Fujimori | 368/291 |
| 4,110,970 | 9/1978 | Funazawa et al. | 368/294 |
| 4,132,062 | 1/1979 | Fujimori | 368/294 |
| 4,206,591 | 6/1980 | Maekawa | 368/295 |
| 4,222,228 | 9/1980 | Masui | 368/291 |
| 4,234,948 | 1/1980 | Maekawa et al. | 368/291 |
| 4,308,611 | 12/1981 | Kanai | 368/291 |

*Primary Examiner*—J. V. Truhe
*Assistant Examiner*—Shelley Wade
*Attorney, Agent, or Firm*—Birch, Stewart, Kolasch & Birch

[57] ABSTRACT

A structure for mounting a bezel in a watch case through a packing and for mounting a glass in the bezel through a packing. The watch case has an axially extending, inside engaging portion and an annular groove provided in a lower portion of the inside engaging portion, and the bezel has an inside annular groove. Each of the packings is adapted to be engaged with the corresponding annular groove.

7 Claims, 9 Drawing Figures

GLASS MOUNTING STRUCTURE FOR WATCHES

This application is a continuation of copending application Ser. No. 114,743, filed on Jan. 24, 1980.

BACKGROUND OF THE INVENTION

The present invention relates to a glass mounting structure for watches and more particularly to a structure for mounting a glass in a watch case through a bezel.

The glass is mounted in the bezel through a resilient sealing packing and the bezel is in turn mounted in the watch case through a resilient sealing packing. Generally, the conventional glass mounting structure is not designed to securely hold the glass and the bezel with a high sealing effect.

SUMMARY OF THE INVENTION

An object of the present invention is to provide a glass mounting structure which may reliably hold the glass and the bezel with a high sealing effect.

Another object of the present invention is to provide a glass mounting structure which may be easily assembled and disassembled.

According to the present invention, there is provided a glass mounting structure comprising a watch case, a bezel, a glass, a first packing disposed between said watch case and bezel, and a second packing disposed between said bezel and glass, said watch case having an upper receiving portion, an axially extending inside engaging portion, an annular groove provided in a lower portion of said axially extending inside engaging portion, and a lower receiving portion laterally extending from a lower portion of said annular groove, said bezel having a peripheral engaging portion for engaging said first packing, an underside portion laterally extending from the upper end of said engaging portion, and an inside annular groove for receiving said second packing, said glass having a periphery adapted to dent in said second packing.

These and other objects and features of the present invention will become more fully apparent from the following description with reference to the accompanying drawings.

DESCRIPTION OF THE PREFERRED EMBODIMENTS

Figure 1:
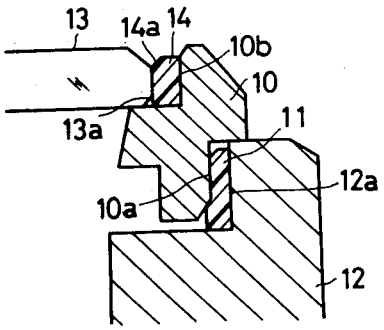
PRIOR ART FIG.1
FIG. 1 is a sectional view showing a conventional glass mounting structure.

Referring to FIG. 1 showing a conventional glass mounting structure, a bezel 10 is mounted in a watch case 12 through a resilient sealing packing 11 of plastic and a glass 13 is mounted in the bezel 10 through a resilient sealing packing 14 of plastic. The packing 11 has a rectangular cross section and has an inner diameter which is slightly smaller than the outer diameter of the lower engaging portion 10*a* of the bezel 10. The outer diameter of the packing 11 is substantially equal to the inner diameter of the engaging portion 12*a* of the watch case 12. Similarly, the packing 14 has a rectangular cross section, the inner diameter of which is slightly smaller than the outer diameter of the glass 13 and the outer diameter of which is substantially equal to the inner diameter of the upper engaging portion 10*b* of the bezel 10. The packing 11 engages the bezel 10 rather than the watch case 12 and the packing 14 engages the glass 13 rather than the bezel 10 such that, when the bezel 10 is removed from the watch case 12, the packing 11 is taken off together with the bezel, and when the glass 13 is removed from the bezel, the packing 14 is taken off together with the glass. The packings 11 and 14 removed from the watch case and the bezel are liable to fly from the bezel and the glass out of sight. In addition, in order to mount the glass again, packings 11 and 14 must be engaged with the watch case 12 and the bezel 10 respectively, which means complexity of assembling. Further, it will be seen that since packings 11 and 14 are merely compressed by opposite members, friction force in each engaging portion is not sufficient to hold the member with a high sealing effect, especially in respect to the packing 14. The reason is that contact surface area of the engaging portion between the packing 14 and the glass 13 is relatively small, because of the facts that the packing 14 has a small height and the contact surface area is further decreased by the beveled guiding portion 13*a* of the glass. Further, in a shaped glass, such as rectangular glass since there is a great error in dimension, defects in holding and sealing effect is remarkably developed.

Figure 2:
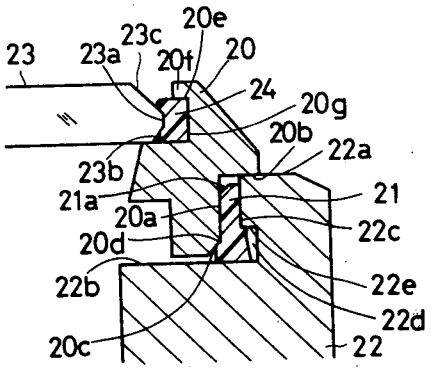
FIG. 2 is a sectional view showing an embodiment of the present invention.

The present invention eliminates the above described disadvantages in the conventional structure. Referring to FIG. 2, a bezel 20 has a peripheral engaging portion 20*a* for a resilient sealing packing 21, an underside portion 20*b* radially extending from the upper end of the engaging portion 20*a*, and a beveled guiding portion 20*c* provided in the lower end portion of the engaging portion 20*a*. A watch case 22 has an upper receiving portion 22*a*, an inside engaging portion 22*c*, a lower receiving portion 22*b*, and an annular groove 22*d* provided in a lower portion of the inside engaging portion 22*c*. The upper edge 22*e* of the annular groove 22*d* is in a higher position than the upper edge 20*d* of the beveled guiding portion 20*c*, so that a lower part of the packing 21 may be engaged with the annular groove 22*d*, and is in a lower position than a half height of the packing 21 for increasing the sealing effect. The packing 21 has a rectangular cross section. The inner diameter of the packing 21 is slightly smaller than the outer diameter of the peripheral engaging portion 20*a* of the bezel 20 and the outer diameter of the packing is substantially equal to the inner diameter of the inside engaging portion 22*c* of the watch case 22. In order to facilitate the insertion of the bezel, a beveled guiding portion 21*a* is provided in the upper inside edge of the packing 21.

The bezel 20 further has an inside annular groove 20*e* for a resilient sealing packing 24. The inner diameter of the flange 20*f* of the groove 20*e* is somewhat greater than the outer diameter of the glass 23. The glass 23 has a beveled guiding portion 23*b* provided in the lower edge of the periphery 23*a* and a beveled portion 23*c* provided in the upper edge of the periphery. The packing 24 has a rectangular cross section, inner diameter of which is slightly smaller than the outer diameter of the glass and the outer diameter is substantially equal to the inner diameter of the inside 20*g* of the annular groove 20*e*. It will be noted that the packing 24 is not provided with a beveled guiding portion such as the guiding portion 14*a* in FIG. 1.

In the assembly of the structure of the present invention, in order to mount the bezel 20 in the watch case, the packing 21 is put on the lower receiving portion 22*b* of the watch case, where the packing abuts on the inside engaging portion 22*c*, after which the bezel is put on the packing abutting the beveled guiding portion 20*c* on the beveled guiding portion 21*a* of the packing and is pressed against the packing so that the bezel is inserted into watch case 22. By the insertion of the bezel, the packing 21 is compressed and deformed so that a lower part of the packing protrudes into the annular groove 22*d* to engage with it and the corner of the groove and inside engaging portion 22*c* edges into the packing. Thus, the packing may be firmly gripped in the watch case.

Therefore, the packing is not removed from the watch case, when the bezel 20 is taken off the watch. Consequently, it is possible to simply insert the bezel into the watch case again.

To mount the glass 23 in the bezel 20, the packing 24 is engaged with the annular groove 20*e*, after which the glass is pressed against the packing with abutting beveled guiding portion 23*b* on the packing, so that the packing is compressed and deformed into the annular groove 20*e*. Thus, the glass may be mounted in the bezel. Since periphery 23*a* of the glass dents in the packing 24 and an upper portion of the packing presses down on the beveled portion 23*c*, the glass is securely mounted in the bezel with a great friction force. Further, the packing 24 is held in the annular groove 20*e*, and the packing is not removed from the bezel when disassembling the glass. Thus, the glass may be easily mounted in re-assembling.

Figure 3A:
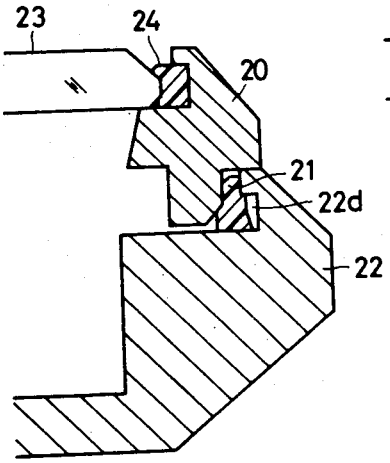
FIG. 3*a* is a sectional view taken along a line connecting indications of 3 o'clock and 9 o'clock on a dial of a watch in another embodiment of the present invention.
Figure 3B:
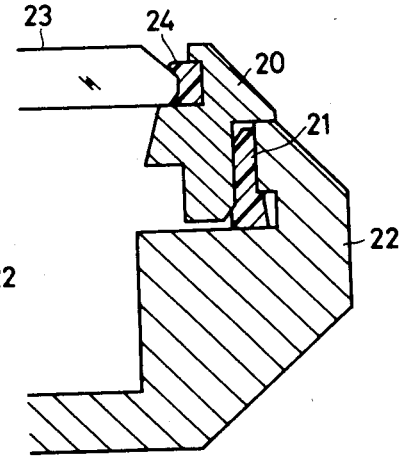
FIG. 3*b* is a sectional view taken long a line connecting indications of 12 o'clock and 6 o'clock in the watch of FIG. 3*a*.

FIGS. 3*a* and 3*b* show the second embodiment of the present invention. Generally, the watch having a thin watch case appears more thin than the watch having a thick watch case, even if entire thicknesses of both watches are equal to each other. However, if the thickness of the watch case is decreased, the thickness of the packing disposed between the watch case and the bezel is decreased, thereby decreasing the friction force and the sealing effect. The second embodiment of the present invention is to resolve such a problem. As shown in FIGS. 3*a* and 3*b*, the thickness of the watch case 22 in the cross section taken along the line connecting indications of 3 o'clock and 9 o'clock (FIG. 3*a*) is smaller than the thickness in the cross section along the line of 12 o'clock and 6 o'clock (FIG. 3*b*). By such a configuration, the watch appears thin. Although the thickness of the packing 21 in the portion of FIG. 3*a* is small, the packing has a greater thickness in the corresponding portion of FIG. 3*b*. Thus, the structure may be made to have a sufficient friction force in the portion of FIG. 3*b* to mount sucurely the bezel 20 in the watch case 22 while retaining a sufficient sealing effect in the portion of FIG. 3*a*.

Figure 4A:
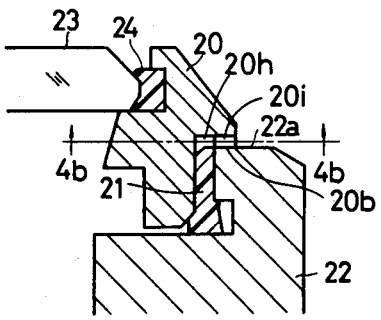
FIG. 4*a* is a sectional view showing another embodiment of the present invention.
Figure 4B:
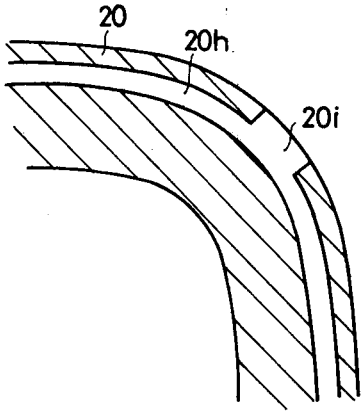
FIG. 4*b* is a sectional view taken along the line 4*b*—4*b* in FIG. 4*a*.

FIGS. 4*a* and 4*b* show the third embodiment of the present invention. The bezel 20 is occasionally raised by the packing 21 so that the underside portion 20*b* of the bezel 20 is separated from the upper receiving portion 22*a*, if there are dimensional errors. Such a gap formed between the bezel and the watch case injures the appearance of the watch. This embodiment may obviate such a defect.

There is provided a downward annular groove 20*h* in the underside portion 20*b* of the bezel 20 so as to receive the projected packing 21. Thus, in accordance with this embodiment, it is possible to prevent the rise of the bezel 20 by the packing 21. In order to facilitate removal of the bezel, a notch 20*i* is provided in the underside portion 20*b* to communicate with the annular groove 20*h*. In this construction, since a tip of a screwdriver inserted into the notch 20*i* is introduced into the annular groove 20*h*, the packing 21 is not damaged by the inserted screwdriver.

Figure 5A:
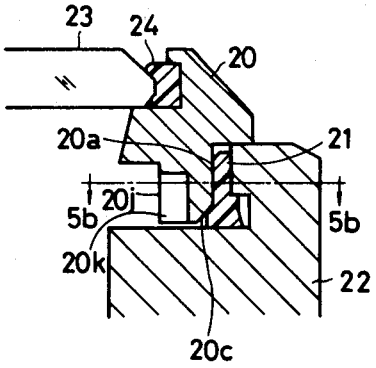
FIG. 5*a* is a sectional view showing a still another embodiment of the present invention.
Figure 5B:
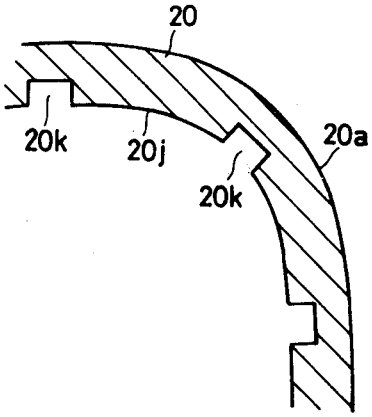
FIG. 5*b* is a sectional view taken along the line 5*b*—5*b* in FIG. 5*a*.

FIGS. 5*a* and 5*b* show the fourth embodiment which is suitable for a shaped glass watch. Each of the shaped bezel 20, packing 21 and watch case 22, for example, having a rectangular shape, occasionally has a considerable dimensional error. Therefore, in some cases, it is difficult to mount the bezel 20 in the watch case because of irregular clearance. Further, the irregular clearance causes irregular friction force and sealing effect. In this embodiment, a plurality of notches 20*k* are provided in an inside portion 20*j* of the bezel 20, at least in a curved portion, opposite the peripheral engaging portion 20*a*. Thus, the bezel 20 may be easily deformed to compensate for any irregular clearance, whereby a secure mounting and sealing effect may be ensured.

Figure 6:
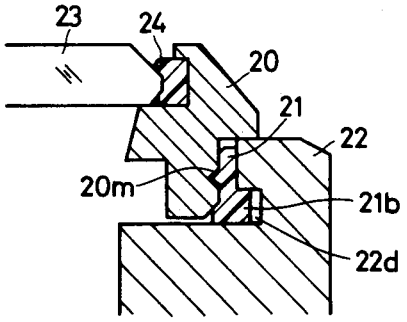
FIG. 6 is a sectinal view showing a further embodiment of the present invention.

Referring to FIG. 6, in this embodiment, the packing 21 has a L-shaped cross section having a projected rim 21*b*. Thus, the packing 21 may be securely engaged with the groove 22*d* by the projected rim 21*b*. On the other hand, the bezel 20 has an annular groove 20*m* having a V-shaped cross section, with which a part of the packing is engaged, thereby to prevent the rise of the bezel.

From the foregoing it will be understood that the assembly and disassembly of the glass and bezel in the structure of the present invention may be easily performed, because the packing is not removed together with the member to be taken off, but sticks to the base member. In addition, since the packing for the bezel is engaged with the annular groove of the watch case and the packing for the glass is engaged with the annular groove of the bezel and upper portion of the packing presses down on the upper beveled portion of the glass, each member may be securely mounted with a sealing effect.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A glass mounting structure comprising a watch case, a bezel, a glass having beveled portions at upper and lower edges thereof, a first packing disposed between said watch case and bezel, and a second packing disposed between said bezel and glass, said watch case having an upper receiving portion, an axially extending inside engaging portion, an annular groove provided in a lower portion of said axially extending inside engaging portion, and a lower receiving portion laterally extending from a lower portion of said annular groove, said bezel having a peripheral engaging portion for engaging said first packing, a lower portion opposite said annular groove, a beveled guiding portion at the lower end of said peripheral engaging portion which is positioned lower than the upper edge of said annular groove, an underside portion laterally extending from the upper end of said engaging portion which overlaps and contacts said upper receiving portion of said watch case, and an inside annular groove for receiving said second packing, the upper boundary of said annular groove for receiving said second packing being spaced from said glass at all times so as not to contact the upper edge beveled portion, the lower boundary of said annular groove for said second packing being extended to the underside of said glass, said bezel being inserted from the upper edge of said first packing thereinto, so that a lower portion of said first packing is expanded into said annular groove of the watch case, whereby when said bezel is removed from said watch case, said first packing is held in said watch case, said glass being downwardly inserted into the second packing, so that a periphery of the glass dents in said second packing and that the upper portion of said second packing presses down on the beveled portion of said upper edge.

2. A glass mounting structure according to claim 1 in which the inner diameter of said first packing is slightly smaller than the outer diameter of the peripheral engaging portion of the bezel and the outer diameter is substantially equal to the diameter of the axially extending inside engaging portion of the watch case, and the inner diameter of said second packing is slightly smaller than the outer diameter of the glass and the outer diameter is substantially equal to the diameter of the inside annular groove of the bezel.

3. A glass mounting structure according to claim 1 in which said watch case is thicker in some portions than others, and the thickness of said first packing is greater in the greater thickness portions of the watch case.

4. A glass mounting structure according to claim 1 in which said underside portion of the bezel has a downward annular groove for receiving the upper portion of the first packing.

5. A glass mounting structure according to claim 4 in which said bezel has a notch provided to be communicated to said downward annular groove for permitting the insertion of a tool.

6. A glass mounting structure according to claim 5 in which said bezel has a plurality of notches in the inside thereof.

7. A glass mounting structure according to claim 1 in which said peripheral engaging portion of the bezel has a V-shaped annular groove with which a part of the first packing engages.

* * * * *